US007719194B2

(12) United States Patent
Aurongzeb

(10) Patent No.: US 7,719,194 B2
(45) Date of Patent: May 18, 2010

(54) INHIBITED OXIDATION FOIL CONNECTOR FOR A LAMP

(75) Inventor: Deeder M. Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 776 days.

(21) Appl. No.: 11/433,108

(22) Filed: May 12, 2006

(65) Prior Publication Data

US 2007/0262688 A1 Nov. 15, 2007

(51) Int. Cl.
*H01J 17/04* (2006.01)
*H01J 61/04* (2006.01)

(52) U.S. Cl. ..... 313/633; 313/285; 313/318.02; 313/331; 313/332; 313/623

(58) Field of Classification Search ..... 313/331–333, 313/335, 352, 355, 623, 633, 279, 285, 634–635, 313/318.02
See application file for complete search history.

(56) References Cited

U.S. PATENT DOCUMENTS

| | | | | |
|---|---|---|---|---|
| 3,420,944 | A * | 1/1969 | Holcomb | 313/318.12 |
| 3,441,776 | A * | 4/1969 | Cardwell, Jr. | 313/273 |
| 3,549,933 | A * | 12/1970 | Smalley | 313/113 |
| 3,609,212 | A * | 9/1971 | Lewis et al. | 174/50.62 |
| 3,723,792 | A * | 3/1973 | Chiola et al. | 313/318.02 |
| 4,015,165 | A | 3/1977 | Hardies | |
| 4,354,137 | A * | 10/1982 | Martin et al. | 313/579 |
| RE31,519 | E * | 2/1984 | Sobieski | 313/332 |
| 4,703,221 | A * | 10/1987 | Ochoa et al. | 313/332 |
| 4,996,116 | A * | 2/1991 | Webster et al. | 428/627 |
| 5,542,867 | A * | 8/1996 | Hishinuma et al. | 445/32 |
| 6,815,892 | B2 * | 11/2004 | Morimoto et al. | 313/633 |
| 2004/0036415 | A1 * | 2/2004 | Kai et al. | 313/626 |
| 2004/0150343 | A1 * | 8/2004 | Takahashi et al. | 313/623 |
| 2007/0138962 | A1 * | 6/2007 | Chowdhury et al. | 313/634 |

FOREIGN PATENT DOCUMENTS

DE 19 57 594 A1 5/1971

(Continued)

OTHER PUBLICATIONS

D.Aurongzeb, K.B.Ram, L.Menon, Influence of Surface/Interface Roughness and Grain Size on Magnetic Property of Le/Co Bilayer, *Applied Physics Letters*, Department of Physics, Texas Tech University, Lubbock, Texas, 79409-1051, (2005).

(Continued)

*Primary Examiner*—Sikha Roy
*Assistant Examiner*—Jose M Diaz
(74) *Attorney, Agent, or Firm*—Fay Sharpe LLP

(57) ABSTRACT

A foil connector (28, 30) suited for use in a lamp (10) is provided. The foil connector includes a substrate layer (40) formed from an electrically conductive material. A coating (42) is provided for reducing oxidation of the substrate during lamp operation. The coating includes a first coating layer (44) on the substrate comprising a noble metal, a second coating layer (46) spaced from the substrate by the first coating layer, the second coating layer comprising a noble metal, and optionally, a third coating layer (48) spaced from the substrate by the first and second coating layers, the third coating layer comprising a noble metal.

15 Claims, 1 Drawing Sheet

FOREIGN PATENT DOCUMENTS

| | | | |
|---|---|---|---|
| DE | 28 00 436 | B1 | 4/1979 |
| DE | 35 37 262 | C2 | 4/1987 |
| EP | 1 04 711 | B1 | 12/1999 |
| GB | 1 012 616 | A | 12/1965 |
| JP | 07 302579 | A | 11/1995 |
| WO | WO 2004/045026 | A2 | 5/2004 |
| WO | WO 2004/097892 | A2 | 11/2004 |

OTHER PUBLICATIONS

D.Aurongzeb, K.B.Ram, L.Menon, Formation of Nickel Nanodots on GaN, *Journal of Applied Physics*, Department of Physics, Texas Tech University , Lubbock, Texas, 79409, (2006).

PCT/US2007/067788 International Search Report and Written Opinion, mailed Jun. 19, 2008.

* cited by examiner

INHIBITED OXIDATION FOIL CONNECTOR FOR A LAMP

BACKGROUND OF THE INVENTION

The invention relates generally to electric lamps formed with a pinched seal, in which a conductive foil is incorporated in the pinch. In particular, it relates to a molybdenum foil which is protected against oxidation by a layer which inhibits oxidation of the foil.

Electric lamps having a quartz glass lamp envelope frequently have outer current conductors of molybdenum which are connected with internal electrodes by a molybdenum foil. The foil is used in the area of the pinch seal. Being more flexible than the thicker molybdenum conductor, it is better able to absorb the stresses placed on the conductor in the pinch area. Molybdenum oxidizes rapidly in an oxidizing environment, such as air at temperatures of about 350° C. and higher. In the case of molybdenum foil used for hermetic pinch and vacuum-formed seals, this oxidation can result in an open circuit or can crack open the seal, either of which results in lamp failure. The oxidation reaction is thought to occur because during the sealing operation, microscopic passageways are formed around the lead wires as the vitreous material cools. These passageways permit oxygen to enter the foil area of the lamp seal.

Chromizing processes have been developed for reducing oxidation of an Mo—Nb pin-foil assembly during lamp operation. In such processes, a relatively thick layer of chromium is deposited on the foil. These processes often provide unsatisfactory results due to difficulties in process control. Additionally, the chromizing layer only allows moderate increases in the foil temperature before oxidation occurs. It has also been proposed to coat the molybdenum in the seal area which is exposed to oxidizing environments with an alkali metal silicate.

BRIEF DESCRIPTION OF THE INVENTION

In an exemplary embodiment of the present invention, a foil connector for a lamp is provided. The foil connector includes a substrate layer formed from an electrically conductive material. A coating for reducing oxidation of the substrate during lamp operation, the coating includes a first coating layer on the substrate comprising a noble metal, a second coating layer spaced from the substrate by the first coating layer, the second coating layer comprising a noble metal, and optionally, a third coating layer spaced from the substrate by the first and second coating layers, the third coating layer comprising a noble metal.

In another aspect, a lamp is proved. The lamp includes an envelope. At least one interior electrode is provided for generating a discharge within the envelope during operation of the lamp. The lamp further includes an exterior connector and a foil connector which electrically connects the exterior connector with the interior electrode. The foil connector includes a substrate layer formed from an electrically conductive material. A first coating layer on the substrate includes a noble metal. A second coating layer is spaced from the substrate by the first coating layer. The second coating layer includes a noble metal. Optionally, a third coating layer is spaced from the substrate by the first and second coating layers, the third coating layer, where present, including a noble metal.

In another aspect, a method of forming a foil connector includes providing a substrate layer which includes an electrically conductive material. Noble metal is deposited on the substrate to form a first layer on the substrate. Deposition of noble metal is halted for a period of time. Thereafter noble metal is deposited over the first layer to form a second layer on the substrate thicker than the first layer. Optionally, deposition of noble metal is halted for a second period of time and thereafter noble metal is deposited over the second layer to form a third layer on the substrate.

DETAILED DESCRIPTION OF THE INVENTION

Aspects of the exemplary embodiments relate to systems and methods for increasing the oxidation resistance of an electrically conductive foil connector for a discharge lamp, such as a molybdenum-containing foil, which may provide an electrical connection between inner and outer electrodes of an electric lamp, for example, in the pinch seal between molybdenum and a vitreous material. In various aspects, the exemplary method increases the oxidation resistance of molybdenum exposed to an oxidizing environment at temperatures between about 250° C. to about 700° C. As a result, the life of hermetic seals around the molybdenum foil and electric lamps employing such seals can be increased. The exemplary foil includes a coating over at least a portion of the molybdenum in the seal area exposed to the oxidizing environment.

It has been found that lamps which nominally operate under conditions which cause a molybdenum foil to reach a temperature of about 400-450° C., can reach much higher temperatures when the voltage is not regulated properly. For example, where voltages are poorly regulated, the foil can reach temperatures of 500-550° C. This is particularly true for high wattage lamps, such as those used for entertainment, e.g., theatrical illumination, nightclub illumination, and the like. Accordingly, lamp failures can occur much more quickly than would normally be predicted. The exemplary coating inhibits the oxidation of the molybdenum foil such that even when the foil reaches temperatures in excess of 450° C., such as 500-600° C., or higher, for extended periods during operation, the oxidation rate of the foil connector is not sufficiently high to be the determining factor in the failure of the lamp.

Figure 1:
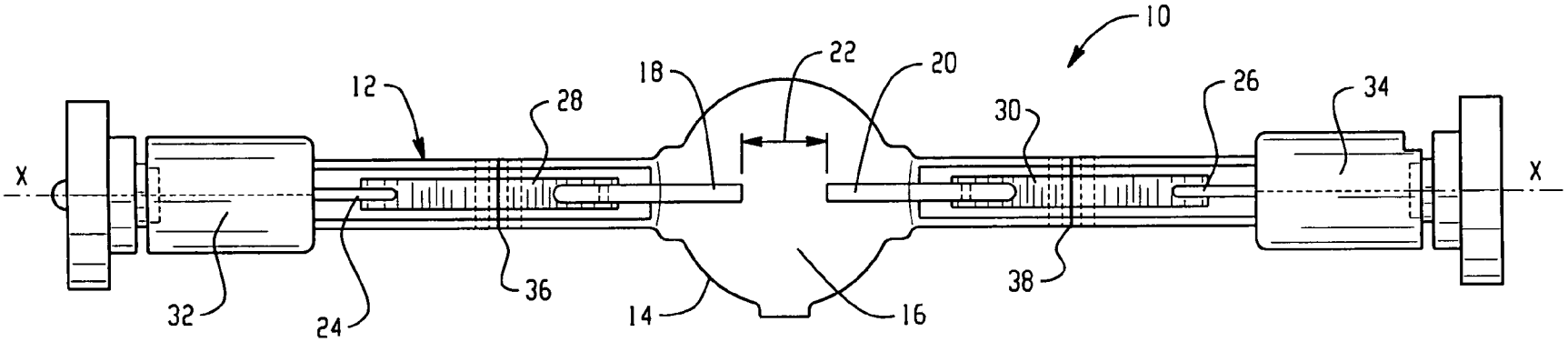
FIG. 1 is a side sectional view of a lamp including a foil connector in accordance with one aspect of the exemplary embodiment.

With reference to FIG. 1, an exemplary lamp 10 includes a light source 12, such as a halogen tube. The tube 12 includes a light transmissive envelope 14, which is typically formed from a transparent vitreous material, such as quartz, fused silica, or aluminosilicate. The envelope defines an internal chamber 16. The envelope 14 may be coated with a UV or infrared reflective coating as appropriate. The exemplary lamp may be a high intensity discharge (HID) lamp which operates at a wattage of at least about 500 W, e.g., at least about 1000 W, and in one embodiment, up to about 4 kW, or higher. Accordingly, the lamp may run relatively hot.

Hermetically sealed within the chamber 16 is a halogen fill, typically comprising an inert gas, such as xenon or krypton, and a halogen source, such as an alkyl halide, e.g., methyl bromide or other bromomethane. A pair of internal electrodes 18, 20 extend horizontally into the chamber 16 from opposite ends thereof and define a gap 22 for supporting an electrical discharge during operation of the lamp. While the exemplary lamp is described in terms of tungsten electrodes 18, 20 as forming an energizable element, other energizable elements are contemplated, such as a filament.

In the following description, all percentages are expressed by weight unless otherwise indicated.

The internal electrodes 18, 20 may be formed primarily from an electrically conductive material, such as tungsten, e.g., at least 50% tungsten, and in one embodiment, at least about 80% or at least 99% tungsten. A longitudinal axis of internal electrodes 18, 20 is coincident with the longitudinal axis X-X of the chamber 16. The internal electrodes 18, 20 are electrically connected with external connectors or pins 24, 26 by foil connectors 28, 30, as described in greater detail below. While in the illustrated embodiment, the electrode 18 is connected to the external connector 24 directly by the foil 28, it is also contemplated that one or more intermediate electrical connectors may space the foil connector 28 from the electrode 18, and similarly for electrode 20. Additionally, while connectors 24, 26 are shown extending from opposite ends of the lamp, it is also contemplated that they may extend in parallel from the same end of the lamp.

The external connectors 24, 26 extend outwardly to bases 32, 34 at respective ends of the envelope 14 for electrical connection with a source of power. Connectors 24, 26 may be in the shape of pins or tubes and may be formed primarily from an electrically conductive material, such as molybdenum or niobium, e.g., at least about 50% molybdenum, and in one embodiment, at least about 80% or at least 99% molybdenum. Other electrically conductive materials are also contemplated, such as a molybdenum alloy, e.g., a molybdenum nickel alloy.

Figure 2:
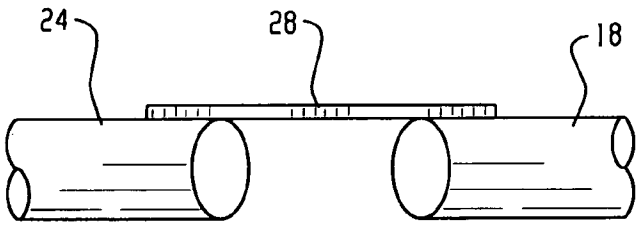
FIG. 2 is an enlarged perspective view illustrating the foil connector of FIG. 1.

As illustrated in FIG. 2, the foil connectors 28, 30 have a thickness, perpendicular to the longitudinal axis, which is substantially less than that of the adjacent connectors 24, 26 and internal electrodes 18, 20. The foil connectors 28, 30 may be welded, brazed, or otherwise connected at ends thereof to the respective external connectors 24, 26 and internal electrodes 18, 20. During assembly of the lamp, the vitreous envelope material is pinched, in the region of the foil connectors 28, 30, to form seals 36, 38. The foil connectors 28, 30 each have a width and length which are substantially greater than a thickness of the foil connector. For example, the thickness of the foil connector may be less than about 0.5 mm, e.g., 0.2-0.3 mm and the width and length at least 1 mm respectively, generally at least 2 mm.

When energized by the source of power, an electrical discharge 22 in the gap provides illumination as well as thermal energy. The thermal energy may be conducted by the electrodes 18, 20 and/or vitreous material to the pinch regions where the foil connectors 28, 30 tend to become heated.

While the exemplary embodiment is described with respect to a tungsten-halogen lamp, it should be appreciated that other light sources may alternatively be employed, such as ceramic metal halide arc tubes, and the like. The term "energizable element," as used herein, thus encompasses filaments and also other energizable materials which generate light on application of an electric current, such as the metal halide fill in the gap between the electrodes of a ceramic metal halide arc tube.

Figure 3:
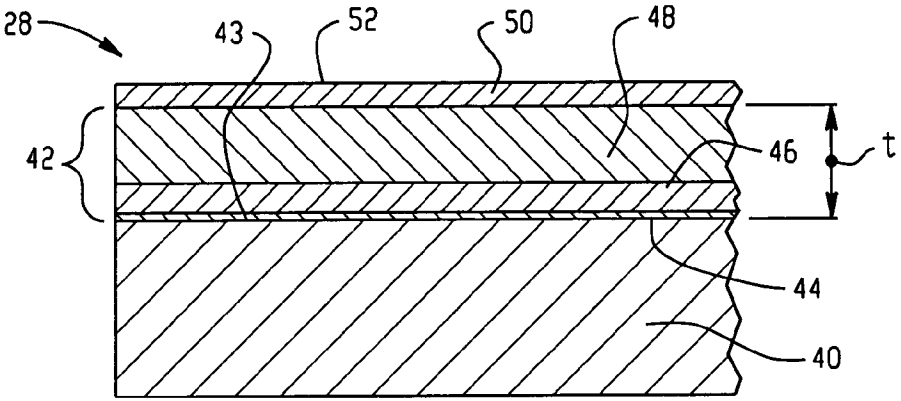
FIG. 3 is an enlarged cross sectional view of a portion of one embodiment of a coated foil for the lamp of FIG. 1.

As illustrated in FIG. 3, the foil connector 28 comprises a substrate layer or foil 40 formed from molybdenum or an alloy thereof, such as a molybdenum-nickel alloy. The foil may comprise molybdenum as a primary component (e.g., at least 10% or at least 20%, 40%, 50%, 60%, 80%, 90%, 95%, 99%, or 99.9% molybdenum) and may comprise molybdenum as its dominant component (about 50% or more). The foil 40 may be at least about 0.1 mm in thickness and may be up to about 0.5 mm, e.g., about 0.2 to about 0.3 mm. A coating 42 formed on a surface 43 of the substrate inhibits the oxidation of the material comprising the foil 40. The coating 42 is thinner than the foil 40 (FIG. 3 illustrates only a portion of the substrate 40). While FIG. 3 shows the coating on an upper surface 43 of the foil, it is to be appreciated that both upper and lower opposed planar surfaces 43 may be similarly coated, and indeed the entire surface of the foil 40. Foil connector 30 may be analogously formed to connector 28.

The coating 42 may comprise a noble metal. In general, the noble metal is one which has an oxidation rate, at lamp operating temperatures, which is less than that of molybdenum. Exemplary noble metals include platinum, gold, nickel, and combinations and alloys thereof. For example, the coating comprises noble metal (i.e., singly or in combination) as a primary component (e.g., the coating 42 is at least 10% or at least 20%, 40%, 50%, 60%, 80%, 90%, 95%, 99%, or 99.9% noble metal). The coating 42 may comprise one layer or a plurality of distinct layers. The multi-layer noble metal coating 42 formed according to the exemplary embodiment reduces the oxidation rate of the molybdenum in the foil. Thus, at a selected temperature in the range of 450-700° C., oxidation rate of the foil 40 is lower than that for a molybdenum foil or chromized molybdenum foil.

Exemplary coatings 42 are those comprising/formed from the substantially pure metal (e.g., at least 90% of Au, Pt, or Ni, such as at least 99% or at least 99.99%) or an alloy thereof, such as an Ni/Al, Au/Al, Au/Ag, Au/Fe, Au/Cr, Au/Mo or Au/Ni alloy, or combination thereof, wherein the coating 42 comprises at least 30% of the first listed (noble metal) element, and in one embodiment, at least about 50%. In the case of platinum, it does not readily form alloys and thus may be used in its substantially pure form. Platinum has a higher melting point than gold and thus may be better suited than gold when lamp operating temperatures are expected to be particularly high at times.

The illustrated coating 42 comprises a plurality of contiguous and substantially coextensive coating layers 44, 46, 48 respectively. Three coating layers are shown in the illustrated embodiment, although fewer or more layers may be employed. Layers 44, 46, 48 may be sequentially deposited on the substrate to form the coating 42. Each layer comprises, as a primary component (e.g., at least 10% or at least 20%, 40%, 50%, 60%, 80%, 90%, 95%, or 99%), a noble metal, which may comprise a single noble metal or mixture of one or more noble metals. In the illustrated embodiment, the same noble metal or alloy thereof is used for forming each of the coating layers. However, it is also contemplated that different noble metals/alloys may be used for the layers 44, 46, 48. Optionally, an outer compatibility layer 50, such as such as a layer of silicon, silicon dioxide alumina, aluminum, or combination thereof, may be provided exterior to the coating 42, for improved bonding with the vitreous material in the pinch 36, 38.

The coating layers 44, 46, 48 may differ in their grain structure. The first layer 44, closest to the substrate, may be at least about 1.5 nanometers (nm) and can be up to about 10 nm in thickness, e.g., 2 nm to about 5 nm, such as about 3-4 nm. In general the thickness of the first layer 44 is selected to be at least sufficient to provide a continuous layer without holes. The first layer may comprise a nanoalloy of the foil material (molybdenum in the illustrated embodiment) and a coating material, such as platinum, gold, or nickel, due to diffusion of the coating material into the top layer of the substrate 40. The nanoalloy layer 44 may be as little as a few molecules in thickness. Above about 10 nm in thickness, the tendency to generate a nanoalloy reduces. Thus, the benefits of the first layer tend not to be improved at greater thicknesses than 10 nm. In the first layer 44, the noble metal(s) may be at a lower concentration than in other layers, but is generally at least 20%, and in one embodiment, at least about 50%. While not committing to any theory, it is believed that the first layer acts as a diffusion barrier, inhibiting diffusion from the subsequent layers into the foil layer 40.

The second layer 46 may be somewhat thicker than the first layer, e.g., about 5 to about 100 nm in thickness, such as about 10-20 nm in thickness, e.g., about 14 nm in thickness, thereby providing a grain structure in which the grains are larger than in the first layer. In general, the second layer may be at least about 5 nm thicker than the first layer. The third layer 46 (and optionally any subsequent layer) is thicker than the second layer 46, thereby providing a further increase in grain size. For example, the third layer 46 may be about 50 nm to about 2 microns in thickness, e.g., about 100 nm to 1 micron, and in one embodiment, about 500 nanometers in thickness. In general, the third layer may be at least about 20 nm thicker than the second layer. The thickness of the third (outermost) layer 46 may be selected according to the anticipated useful lifetime of the lamp in hours. Since oxygen penetrates progressively through this layer, the thicker the layer, the longer the time for the layer to be penetrated. The exemplary third layer thickness is based on an expected lamp life of about 1000 hours. The oxidation resisting coating 42 may have a total thickness t of up to about 1 micron, generally, about 600 nm or less.

The compatibility layer 50, where present, may be from about 50 to about 500 nm in thickness, e.g., about 100 nm. Accordingly, an outer surface 52 of the foil connector 28, 30 (provided by the coating 42, if no compatibility layer 50 is present) which contacts the vitreous material in the pinch, is, in one embodiment, no greater than about 1.5 microns from the surface 43 of the foil layer 40, and is generally less than 1 micron.

The second and third layers 46, 48 may include a higher concentration of the coating material than the first layer 44, since diffusion into the underlying substrate 40 is inhibited by the intermediate first layer 44. In layers 46 and 48, for example, the noble metal may be at a concentration of at least about 50%, and in one embodiment, at least about 80% and can be up to 100%. In the illustrated embodiment, each layer is in direct contact with the subsequent layer at a grain boundary.

The coating 42 may be formed by a suitable controlled deposition technique, such as sputtering, e-beam deposition, thermal deposition, electroplating, combination thereof, or the like. In general the layers are deposited sequentially, allowing sufficient time between deposition of each layer to allow cooling of the deposited layer such that the subsequently applied layer will have its own unique grain structure.

For example, in an exemplary sputtering technique, the foil 40 to be coated in placed in an evacuable chamber comprising a target formed of the coating material (e.g., a gold or platinum target). Where an alloy is to be deposited as the coating material, a single target comprising the alloy may be employed. Alternatively, two or more targets, each comprising one of the elements to form the alloy may be employed. The chamber is evacuated to suitable vacuum conditions (such as about 5 Torr argon) and sputtering commenced at a suitable chamber operating temperature, such as about 300° C. The foil may be rotated such that both sides 43 are coated.

In the case of the first layer 44, which is deposited directly on the substrate 40, sputtering continues until the desired thickness (e.g., about 3-4 nm of Au or Pt) is deposited on surface 43. The sputtering is then halted. During a subsequent rest period, which may last for about 2 minutes or more and generally less than about 1 hour, e.g., about 5 minutes, cooling of the foil and first layer 44 may occur. For example, the foil and first layer may be allowed to cool to a temperature of about 100° C., or below. During the sputtering and subsequent cooling period, the coating material (e.g., Au or Pt) in the first layer and the foil material (e.g., Mo) in an outermost region of the foil form an interdiffused solid solution which subsequently serves as a diffusion barrier to inhibit penetration of oxygen to the underlying foil. After sufficient time for forming a grain plane which will provide a grain boundary between first and second layers 44, 46, the target (or a different noble metal target) is sputtered at the operating temperature for sufficient time to form the second layer 46, e.g., about 14 nm of Au or Pt is deposited. Thereafter the sputtering is again stopped and the coated foil may be allowed to cool for sufficient time to form a second grain boundary between the second and third layers (e.g., at least about 2 minutes, such as 5 minutes, as for the first cooling period). The second coating layer 46 does not penetrate the foil 40 beneath to any significant extent because of the intervening first layer 44. Thus, the second layer has a higher concentration of the coating material than the first layer.

Thereafter, the target (or a different noble metal target) is sputtered again at the operating temperature for sufficient time to deposit the third layer, e.g., about 500 nm of Au or Pt. Where a layer 50 is employed a second target may be sputtered or other controlled deposition technique employed to form the outer layer. For example, a layer of aluminum 50 about 100 nm in thickness is deposited to provide a lamp with generally longer life when the vitreous material of the envelope is an aluminosilicate glass. This can provide a good match with the glass in the pinch, creating a better seal. For quartz envelopes, silicon or silicon dioxide may be used for the outer layer 50.

The thus-formed foil connector 28 may be attached to the outer connector 24 and inner electrode 18 to form an electrical path therebetween in a conventional manner, e.g., by welding with platinum taps. Alternatively, depending on the coating 42, the foil connector 28 may be attached by brazing, directly to the electrode 18 and outer connector 24, without any intervening welding material. The assembly 24, 28, 18, and corresponding assembly 20, 30, 26 may then be fitted into respective ends of the envelope 14 such that tips of electrodes 18, 20 protrude into the chamber 16 and are spaced by a suitable gap 22. The envelope 14 is heated and constricted adjacent the foil connectors 28, 30 to form the pinch seals 36, 38. Base connectors 32, 34 may then be connected with outer electrodes 24, 26. The finished lamp 10 may be positioned in a suitable housing comprising a reflector (not shown) and connected with a source of electrical power.

During lamp operation, the thus formed lamp 10 may reach temperatures in the range of 500-600° C., at the coated foil 28, and the coated foil may be exposed to environments typically containing up to about 1% oxygen with a substantially lower failure rate than for conventional lamps.

The multilayer coating structure 42 thus described creates a spring-like member on the surface of the foil 40 which is able to absorb stresses in the pinch 36, 38, due in part to the grain size gradient (smaller grains adjacent the foil, larger grains further way from the foil). This property, in addition to the improved oxidation resistance, reduces lamp failures thereby providing a generally longer average lifetime for lamps which include the coated foil. Other advantages which may be realized by the exemplary coated foil include increasing the foil oxidation temperature up to about 600° C., or higher, as well as provision of a better conducting path and improved process control.

Without intending to limit the scope of the exemplary embodiment, the following example demonstrates the effectiveness of a coating for inhibiting oxidation.

Example

Accelerated tests were performed outside a lamp environment to evaluate the coating. In a first test, molybdenum foil about 0.025 mm in thickness was coated with first and second gold layers 4 nm and 14 nm in thickness, respectively, analogous to layers 44, 46. No third layer was used in these tests. Through diffusion into the molybdenum substrate 40, a nanoalloyed first layer 44 somewhat thicker than 4 nm was formed with a grain plane about 14 nm thick thereover. The coated sample was exposed in air (25% oxygen) in an oven which was heated to 700° C. Over a period of three days, no changes in the crystal structure or brittleness were observed. Thereafter, small protrusions began to appear.

In a second test, molybdenum foil without the coating was subjected to the same conditions as in the first test. Within 2-3 hours, the foil began to show signs of brittleness. The molybdenum became granular and lost integrity. Microscopic examination of the surface revealed protrusions on the molybdenum surface, indicative of oxidation.

In a third test, molybdenum foil with a layer of silicon dioxide 100 nm in thickness was subjected to the same conditions as in the first test to establish that this would not hinder the molybdenum.

Brittleness was tested with mechanical impact and resistivity measurements. Mechanical impact with a sharp edge turned the uncoated foil into small pieces which are mainly oxide pieces of about 500 micrometers in size. Resistance measurements showed the resistance of the coated foils, even with a higher temperature anneal, to be less than 1 ohm, whereas the uncoated foil showed resistance to be greater than 1 mega-ohm.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

an envelope;

at least one interior electrode for generating a discharge within the envelope during operation of the lamp;

an exterior connector; and a foil connector which electrically connects the exterior connector with the interior electrode, the foil connector comprising:

a substrate layer formed from an electrically conductive material; and a coating for reducing oxidation of the substrate during lamp operation, the coating comprising:

a first coating layer on the substrate comprising a noble metal;

a second coating layer spaced from the substrate by the first coating layer, the second coating layer comprising the same noble metal, the second coating layer differing in its grain size from the first coating layer; and optionally, a third coating layer spaced from the substrate by the first and second coating layers, the third coating layer, where present, comprising a noble metal.

2. The lamp of claim 1, wherein the substrate comprises molybdenum as a primary component thereof.

3. The lamp of claim 1, wherein the first coating layer is thinner than the second coating layer.

4. The lamp of claim 1, wherein the first coating layer is less than about 10 nm in thickness.

5. The lamp of claim 1, wherein the second coating layer is at least about 5 nm greater in thickness than the first layer.

6. The lamp of claim 1, wherein the first and second coating layers, and third coating layer, where present, differ in their grain structure.

7. The lamp of claim 1, wherein the noble metal in the first and second coating layers is the same.

8. The lamp of claim 1, wherein the first and second coating layers each comprise at least 50% by weight of noble metal.

9. The lamp of claim 1, wherein the coating comprises the third coating layer.

10. The lamp of claim 9, wherein the third coating layer is the outermost layer of the foil connector.

11. The lamp of claim 1, further comprising an outermost layer, spaced from the substrate layer by the first and second layers and the third layer, where present, the outermost layer comprising at least one of the group consisting of aluminum, silicon, an oxide of aluminum, an oxide of silicon, and combinations thereof.

12. An interface comprising a foil connector and an electrode, the foil connector comprising:

a substrate layer formed from an electrically conductive material; and a coating for reducing oxidation of the substrate during lamp operation, the coating comprising:

a first coating layer on the substrate comprising gold or platinum;

a second coating layer spaced from the substrate by the first coating layer, the second coating layer comprising gold or platinum at a higher concentration than in the first layer; and optionally, a third coating layer spaced from the substrate by the first and second coating layers, the third coating layer, where present, comprising a noble metal.

13. A lamp comprising the interface of claim 12.

14. A lamp comprising:

an envelope;

at least one interior electrode for generating a discharge within the envelope during operation of the lamp;

an exterior connector; and a foil connector which electrically connects the exterior connector with the interior electrode, the foil connector comprising:

a substrate layer formed from an electrically conductive material, a first coating layer on the substrate comprising a noble metal, the first coating layer comprising gold or platinum and being less than about 10 nm in thickness, a second coating layer spaced from the substrate by the first coating layer, the second coating layer comprising a noble metal, and optionally, a third coating layer spaced from the substrate by the first and second coating layers, the third coating layer comprising a noble metal.

15. The lamp of claim 1, wherein second layer has a larger gram size than the first layer.

* * * * *